United States Patent [19]

Culbertson et al.

[11] 4,331,299

[45] May 25, 1982

[54] SAFETY COVER FOR ROTARY HEAD ELECTROSTATIC SPRAY COATING SYSTEMS

[75] Inventors: Samuel W. Culbertson, Arvada; Charles W. McCulloch, Westminster; Keith G. Williams, Boulder, all of Colo.

[73] Assignee: Binks Manufacturing Company, Franklin Park, Ill.

[21] Appl. No.: 163,151

[22] Filed: Jun. 26, 1980

[51] Int. Cl.[3] ..... B05B 5/04

[52] U.S. Cl. ..... 239/691; 239/112; 239/122; 239/288.5

[58] Field of Search ..... 239/691, 700–703, 239/112, 120–122, 214, 223, 224, 288–288.5, DIG. 14

[56] References Cited

U.S. PATENT DOCUMENTS

| | | | |
|---|---|---|---|
| 2,555,271 | 5/1951 | Jauch et al. | 239/288 |
| 2,784,114 | 3/1957 | Miller | 239/703 |
| 2,842,093 | 7/1958 | O'Neill | 239/104 |
| 2,967,669 | 1/1961 | Norris | 239/701 |
| 3,086,711 | 4/1963 | Point | 239/700 |
| 3,155,539 | 11/1964 | Juvinall | 239/122 |
| 3,944,141 | 3/1976 | Siczek | 239/288.5 |

*Primary Examiner*—Robert B. Reeves
*Assistant Examiner*—Michael J. Forman
*Attorney, Agent, or Firm*—Gary, Juettner & Pyle

[57] ABSTRACT

A safety cover for rotary head electrostatic spray coating systems, of the type to which a rapid rotation is imparted to a rotary spray head and a jet of coating material to be sprayed directed thereagainst for discharge from a peripheral edge of the head in a spray, is characterized by a cover movable between positions over and around the head and remote from the head, and a mechanism for moving the cover. When positioned over the head, the cover protects nearby personnel against accidental injury resulting from contact with the rapidly rotating head, and at the same time serves as a receptacle for receiving and containing solvent and residual coating material discharged from the head when the same is cleaned, as for example during color changes when coating materials of different colors are sprayed.

10 Claims, 2 Drawing Figures

SAFETY COVER FOR ROTARY HEAD ELECTROSTATIC SPRAY COATING SYSTEMS

BACKGROUND OF THE INVENTION

The present invention relates to safety devices for spray coating apparatus of the type which comprise a centrifugal sprayer member or head to which a rapid rotation is imparted, and in particular to a safety cover for the rotating head which both shields the same against accidental contact therewith by nearby personnel and acts as a receptacle for residual materials during changes in color of the coating materials.

Electrostatic spray coating systems have been successfully used in commerce in several different forms. For example, systems have been used which utilize spraying or atomizing devices employing hydraulic forces or air as the atomizing medium. In another type of system which does not require air or hydraulic forces for atomizing coating material, however, atomization is accomplished by means of a centrifugal sprayer member or head to which a rapid rotation is imparted. The head has a surface against which a stream or jet of liquid to be sprayed is directed, the liquid on striking the revolving surface progressing radially outwardly thereover in a thin film under centrifugal force toward a sharp annular peripheral edge of the head, whereat it is divided into fine particles so that it leaves the periphery in the form of a spray. For electrostatic deposition of the coating material the rotating head is of a conductive material and connected to a high d.c. potential, so that the spray particles on moving past the peripheral edge of the head are charged to a high electrostatic potential. The resulting ionized or electrostatically charged cloud of particles is then attracted to and settles on the surface of the articles or ware to be coated, which are usually maintained at ground potential.

Heretofore the spray heads of such electrostatic coating apparatus have been rotated at relatively low speeds, i.e., on the order of 3000 to 6000 rpm. However, recent developments contemplate rotating the heads at considerably greater speeds on the order of 30,000 to 60,000 rpm, which enhances both the atomization and flow rate of material sprayed from the head. Quite obviously, the sharp peripheral edges of spray heads rotated at such high speeds present a significant danger to nearby personnel who might accidentally contact the same. Although the danger of personal injury is somewhat less when the head is energized, since the head is normally rotated by an air turbine the noise of which is a warning, the danger increases upon deenergization of the head and for a period of time thereafter. That is, upon deenergization turbine noise ceases, yet because of inertia and the high speed of rotation, the head continues to rotate for a period of time at speeds which may still cause severe injury to a person contacting the same.

When used in industrial operations where articles are to be spray coated as they move along a production line, and where the articles are required to be coated a wide variety of colors, color change system are often used with rotary head spray coating apparatus, and enable different colored coating material to be sequentially sprayed from a single head. However, to effect a color change the head must first be cleansed of previously sprayed material, which is usually accomplished by introducing onto and spraying from the head a small amount of solvent for the material. To prevent the solvent and residual amounts of the previously sprayed material from being deposited on articles during the cleaning process, the prior art contemplates moving the spray apparatus to a position remote from the articles whereat the solvent and residual material may be sprayed from the head without being deposited on the articles. In the case where the articles conveyed past the coating station are closely spaced, the resulting time limitations imposed by the color change process often requires operation of the production line at a speed which is less than desirable or optimal.

OBJECTS OF THE INVENTION

An object of the present invention is to provide a safety cover for a rotary spray head of an electrostatic spray coating apparatus, which is operable to shield the head against accidental contact by nearby personnel.

Another object of the invention is to provide such a safety cover, which also serves as a receptacle for solvent and residual coating material sprayed from the head during color change operations, thereby permitting rapid color changes to be accomplished without need to move the spraying apparatus to a position remote from articles to be coated.

SUMMARY OF THE INVENTION

In accordance with the present invention, there is provided a safety cover assembly for use in combination with a rotary head electrostatic spray coating apparatus of the type to which a rapid rotation is imparted to a rotary spray head onto which coating material is introduced for discharge of the material in a spray from a peripheral edge of the head for deposit on articles. The safety cover assembly comprises a shroud having an opening thereto, and means for moving said shroud between a position remote from the spray head and a position about the head with at least the peripheral edge of the head received within said opening. In this manner, when said shroud is about the rotary head, nearby personnel are protected against contact with the peripheral edge of the head.

Said means for moving said shroud advantageously includes an arm connected at one end with said shroud, a pinion gear at an opposite end of said arm, a cylinder, a piston in said cylinder and a piston rod connected with said piston for movement therewith, said piston rod being formed with gear teeth which define a rack. Said gear teeth are meshed with said pinion gear, and means reciprocates said piston in said cylinder to reciprocate said piston rod and rotate said pinion gear and said arm, thereby to move said shroud between the positions remote from and about the rotary head. In one embodiment said means for reciprocating said piston includes a spring for moving said piston in one direction in the cylinder, and means for introducing air under pressure into said cylinder to move said piston in an opposite direction against the urging of the spring. In another embodiment said means for reciprocating comprises means for introducing air under pressure into said cylinder on one side or the other of said piston.

Said shroud has a closed end opposite from said opening, and in use of the same in color change operations, said shroud forms a container for receiving therein material sprayed from the rotary head when at least the periphery of the head is within said shroud opening, whereby said shroud prevents deposition of solvent and/or residual coating materials on articles during cleaning of the rotary spray head. Said shroud is generally cup-shaped and permits escape of material therefrom during cleaning of the head, advantageously by allowing the material to drip through said shroud opening.

The invention thus provides an improved safety cover assembly for rotary electrostatic spray coating apparatus, which not only protects nearby personnel against the danger of accidental contact with and injury by a rapidly rotating spray head of the apparatus, but also enables changes in colors of the coating materials sprayed to be quickly and conveniently made without deposition of unwanted material and/or solvent on articles to be coated, and without need to move the spray assembly to a position remote from its normal spraying location.

The foregoing and other objects, advantages and features of the invention will become apparent upon a consideration of the following detailed description, when taken in conjunction with the accompanying drawings.

DETAILED DESCRIPTION

Figure 1:
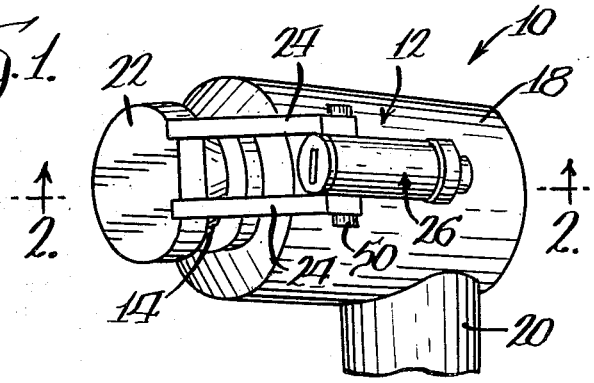
FIG. 1 is a perspective view of a safety cover constructed in accordance with the teachings of the present invention, showing the same mounted on a rotary head electrostatic spray coating apparatus in a position covering the rotary head of the apparatus.

The invention provides a safety device for a rotary head electrostatic spray coating apparatus of the type comprising a centrifugal spray head to which a rapid rotation is imparted. The head has an inside surface against which a stream or jet of coating material to be sprayed is directed, the liquid on striking the surface progressing outwardly thereover in a thin film under centrifugal force toward a sharp annular peripheral edge of the head, whereat it is divided into fine particles so that it leaves the periphery in the form of a spray. The head is connected to a high d.c. voltage so that the spray particles moving past its peripheral edge are charged to a high electrostatic potential, and the ware or articles on which the spray is to be deposited are maintained at a different and usually ground potential, whereby the spray particles leaving the head are electrostatically attracted to the articles for deposit thereon.

To enhance atomization of the spray material at an increased flow rate, recent developments contemplate rotating the head at a very high rate on the order of 30,000 to 60,000 rpm. At such high speeds, the sharp peripheral edge of the rotating head presents a significant danger to nearby personnel who might accidentally contact the same, and for that reason the safety cover of the invention has been provided to shield the head against accidental contact by individuals. At the same time, the safety cover advantageously provides a means by which changes in colors of coating materials sprayed from the head may be quickly and conveniently made without depositing cleansing solvent and/or residual coating material on articles to be coated, and without need to move the coating apparatus from its normal position to a position remote from the articles. In this connection, upon actuation the safety cover also forms a receptacle about the head for receiving and containing therein solvent and residual coating material discharged in a spray from the head during cleaning, thereby preventing the unwanted deposition of such materials on articles.

Referring now to the drawings, there is indicated generally at 10 a rotary head electrostatic spray coating apparatus on which is mounted a safety and color change cover mechanism, indicated generally at 12, constructed in accordance with a preferred embodiment of the invention. The spray coating apparatus includes a rotatable, bell-shaped head 14 of conductive material, mounted on an output shaft 16 of a high speed air driven turbine 18. The turbine rotates the head at a high rate of speed on the order of 30,000 to 60,000 rpm, and is supported on the end of an arm 20 of insulating material. An opposite end of the arm is connected to any suitable mechanism (not shown) for moving the apparatus to positions permitting proper deposition of coating material on articles, for example articles moved past the spray assembly on a conveyor.

Although not specifically illustrated, but as is understood, in use of electrostatic spray coating apparatus of the general type a stream or jet of coating material to be sprayed is directed onto an interior surface of the rotating head 14, the liquid on striking the revolving surface progressing radially outwardly thereover under centrifugal force toward a sharp, annular, peripheral edge 20 of the head, whereat it is divided as it leaves the head into fine particles in the form of a spray. A high d.c. voltage, which may be on the order of 120,000 volts, is connected with the head, so that the spray particles on moving past the peripheral edge are charged to a high electrostatic potential and are attracted to articles to be coated, which are maintained at a different and usually ground potential. By virtue of electrostatic attraction of the charged particles to the articles, increases are obtained in the percentages of spray material deposited on the articles, with the support arm 20 of insulating material isolating peripheral equipment from the high voltages present at the spray assembly 10.

Figure 2:
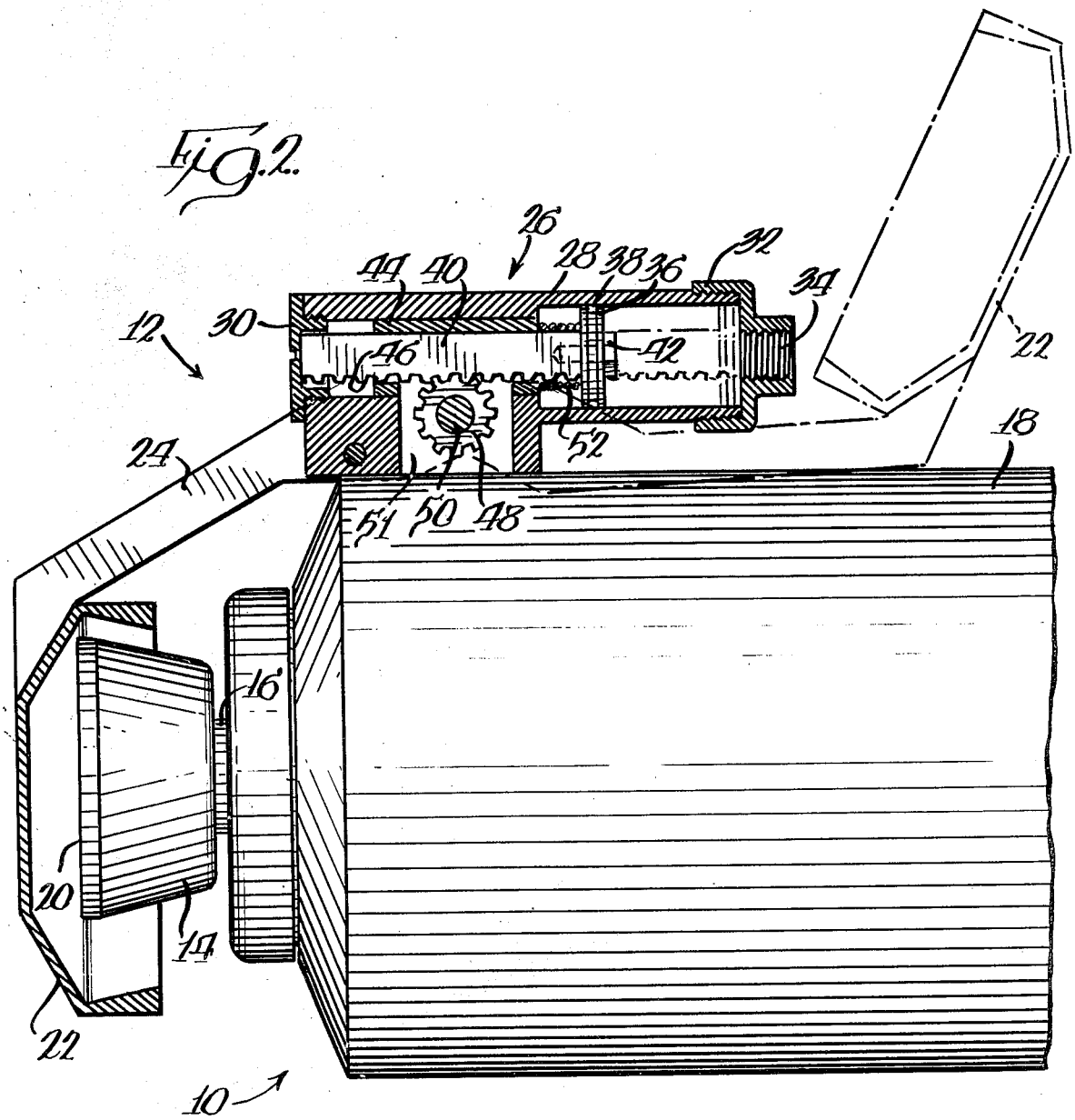
FIG. 2 is a bottom plan view, partly in cross section, taken substantially along the lines 2—2 of FIG. 1, illustrating the mechanism for moving the safety cover and showing the cover in its positions enclosing and exposing the rotary spray head.

Considering the salient features of the safety and color change cover assembly 12 of the invention, a cover, cap or shroud 22 is connected by a pair of arms 24 with an actuating mechanism, indicated generally at 26, for moving the cover between positions enclosing and exposing the rotary head 14. As is best shown in FIG. 2, when the cover is moved to its position surrounding the head, as shown in solid lines, it extends around, over and encompasses at least the forward portion of the head, whereby the sharp peripheral edge 20 is shielded against accidental contact by nearby personnel. However, when moved to its position remote from and exposing the head, as shown in phantom lines, the head is totally free and unencumbered for spray coating operations.

The actuating mechanism 26 for moving the cover 22 between its positions enclosing and exposing the rotary spray head 14 is mounted on the turbine 18 and includes a cylinder 28 having a closure 30 threaded into one end thereof and an air inlet fitting 32 threaded onto an opposite end thereof. The air inlet fitting has a passage 34 for connection with a supply line (not shown) of air under pressure, and a piston 36 having a peripheral seal 38 is reciprocatable in the cylinder. A piston rod 40 connects with the piston by means of a fastener 42, and is guided for reciprocating movement in the cylinder by a sleeve 44. The piston rod is formed with teeth 46 to define a rack, and a pinion gear 48 meshes with the rack. The pinion gear is centrally mounted on a shaft 50 rotatably supported in a pair of spaced mounting plates 51 (only one of which is shown) and extending between ends of the arms 24, whereby reciprocation of the piston rod rotates the pinion to move the arms and therethrough the cover 22 between positions enclosing and exposing the rotary spray head 14. A coil spring 52 is under compression between the piston and a facing end of the sleeve, and urges the piston and rack in a direction to move the cover to its open position.

In operation of the safety cover assembly 12, for the particular arrangement of components shown and in the absence of air under pressure at the passage 34, the spring 52 urges the piston 36 and rack 40 rightwardly (as shown in the drawings) to rotate the pinion 48 in a direction which moves the cover 22 to its open position as shown in phantom lines, thereby exposing the rotary spray head 14 for deposition of coating material on articles. Then, when it is desired to move the cover to its position about the head to provide a shield against accidental contact therewith by nearby personnel, air under pressure is introduced at the passage 34 to move the piston and rack leftwardly and to rotate the pinion in the direction moving the cover to its closed position. Thus, movement of the cover between its open and closed positions may be expediently controlled simply by controlling the presence or absence of air under pressure at the passage 34.

Obviously, other arrangements of the safety cover structure could be used to determine and/or control the position of the cover 22. For example, the spring 52 could be on the opposite or right side of the piston 36, and the closure 30 and air fitting 32 interchanged. With such an arrangement, in the absence of air under pressure at the passage 34 the spring would move the piston and rack leftwardly to move the cover to its position surrounding the rotary spray head 14. Under this condition, the cover would then be moved to its open position exposing the head by application of air under pressure through the passage and into the left side of the cylinder to move the piston and rack rightwardly. Such an arrangement would advantageously provide the added safety feature of ensuring that the rotary head was enclosed and shielded against accidental contact in the event of system failure through loss of air under pressure.

It is also contemplated that the spring could be removed, and a second air fitting 32 be provided in place of the closure 30. This would enable control over movement of the cover to be exercised solely by application of compressed air to the actuating mechanism 26, such that air applied to the left side of the cylinder would open the cover, while air applied to the right side would cause the cover to move to its closed position surrounding the rotary head.

It should also be appreciated that the safety cover mechanism conveniently enables changes to be rapidly made in the colors of coating materials sprayed, without moving the spray assembly from a normal position in proximity with articles conveyed therepast and without deposition of unwanted solvent and/or residual coating material on the articles. To this end, to effect a change from coating material of a first color to coating material of a second, upon completion of spraying coating material of the first color the high d.c. voltage applied to the rotary head 14 is interrupted and the cover 22 moved to its position shrouding the head. A burst of solvent for the coating material is then injected through the material supply line and into the head to clean the supply line and head of the coating material of the first color, with the solvent and residual coating material being sprayed into and contained within the cover. Thus, deposition on articles of unwanted solvent and residual coating material is prevented. Thereafter, to spray coating material of the second color the cover is again moved to its open position exposing the head, the high voltage is applied to the head and coating material of the second color is introduced therein. Advantageously, for the purpose of effecting color changes the actuating mechanism 26 is mounted on the side of the turbine 18 so that the cover lies and moves in a generally horizontal plane about the assembly, whereby solvent and residual coating material received in the cover simply run out of the cover without dripping on the assembly, and there is no need to empty the cover between color changes.

The invention thus provides an improved safety cover for rotary electrostatic spray coating apparatus, which not only protects personnel against the danger of accidental contact with a rapidly rotating spray head, but also enables changes in colors of the coating materials sprayed to be quickly and conveniently made without deposition of unwanted materials or solvent on articles to be coated, and without need to move the spray assembly to a position remote from its normal spraying location. Movement of the cover between its operative and inoperative positions is conveniently accomplished by selective application of compressed air, although it is understood that any other suitable motor means could be used in place of the actuating mechanism 26, such for example as an electrically operated solenoid.

While one embodiment of the invention has been described in detail, it is understood that various modifications and other embodiments thereof could be devised by one skilled in the art without departing from the spirit and scope of the invention, as defined in the appended claims.

What is claimed is:

1. In combination with a rotary head electrostatic spray coating apparatus of the type to which a rapid rotation is imparted by motor means to a rotary spray head onto which coating material is introduced for discharge of the material in a spray from a peripheral edge of the head for deposit on an article, a safety cover assembly comprising a shroud having front and side walls and an opening to the interior thereof, said front wall defining a closed end of said shroud opposite from said opening; and means for moving said shroud between a position remote from the spray head away from an article onto which coating material is to be deposited and a position about the head with at least the peripheral edge of the head received within said opening and enclosed by said front and side walls, so that when said shroud is about the head nearby personnel are protected against contact with the peripheral edge of the rotary head.

2. The combination as in claim 1, wherein said shroud is generally cup-shaped, and said side walls extend from said front wall and define said opening, and wherein said shroud position remote from the head is rearwardly of the head.

3. The combination as in claim 1, wherein said means for moving includes a rack and pinion mechanism for moving said shroud through an arcuate path between the positions remote from and about the spray head.

4. The combination as in claim 1, wherein said shroud forms a container for receiving therein coating material sprayed from the rotary head when at least the periphery of the head is within said opening, whereby said shroud prevents deposition of solvent and/or residual coating material on articles during cleaning of the rotary spray head.

5. The combination as in claim 4, wherein said shroud is generally cup-shaped and permits escape of coating material therefrom during cleaning of the rotary head without deposition of the material on articles.

6. The combination as in claim 5, wherein material sprayed from the head during cleaning thereof escapes from said shroud by dripping out of said shroud through said opening.

7. The combination as in claim 1, wherein said means for moving said shroud is mounted on the motor means and moves said shroud through an arcuate path between positions rearwardly of and generally forwardly of and about the spray head.

8. In combination with a rotary head electrostatic spray coating apparatus of the type to which a rapid rotation is imparted by motor means to a rotary spray head onto which coating material is introduced for discharge of the material in a spray from a peripheral edge of the head for deposit on an article, a safety cover assembly comprising a shroud having an opening thereto; and means for moving said shroud between a position remote from the spray head and a position about the head with at least the peripheral edge of the head received within said opening, so that when said shroud is about the head nearby personnel are protected against contact with the peripheral edge of the rotary head, wherein said means for moving includes an arm connected at one end with said shroud; a pinion gear fixed at an opposite end of said arm; a cylinder; a piston in said cylinder; a piston rod connected with said piston for movement therewith, said piston rod being formed with gear teeth which define a rack and said gear teeth being meshed with said pinion gear; and means for reciprocating said piston in said cylinder to reciprocate said piston rod and rotate said pinion gear and said arm, thereby to move said shroud between said positions remote from and about the rotary head.

9. The combination as in claim 8, wherein said means for reciprocating said piston includes a spring in said cylinder for moving said piston in one direction therein, and means for introducing air under pressure into said cylinder to move said piston in an opposite direction against the urging of said spring.

10. The combination as in claim 9, wherein said means for reciprocating said piston comprises means for introducing air under pressure into said cylinder on one side or the other of said piston.

* * * * *